US005165455A

United States Patent [19]

De Crane

[11] Patent Number: 5,165,455

[45] Date of Patent: Nov. 24, 1992

[54] METHOD FOR HANGING A BULK UNFILLED BAG ON LATCHES OF A BAG FILLING MACHINE

[76] Inventor: Charles E. De Crane, 802 Janna St., West Monroe, La. 71921

[21] Appl. No.: 692,693

[22] Filed: Apr. 29, 1991

[51] Int. Cl.[5] ..... B65B 1/32

[52] U.S. Cl. ..... 141/10; 141/114; 141/314; 53/570; 248/99

[58] Field of Search ..... 141/10, 114, 313-317, 141/385, 75, 76, 166; 248/95, 97, 99, 100, 101; 53/570, 571, 740

[56] References Cited

U.S. PATENT DOCUMENTS

| | | | |
|---|---|---|---|
| 2,423,325 | 7/1947 | Jones | 248/100 |
| 2,451,829 | 10/1948 | Hightower | 248/100 |
| 2,648,512 | 8/1953 | Scholin | 248/100 |
| 4,054,161 | 10/1977 | Alack | 141/12 |
| 4,182,386 | 1/1980 | Alack | 141/83 |
| 4,519,426 | 5/1985 | Hardy, Jr. | 141/114 X |
| 4,676,284 | 2/1987 | DeCrane | 141/114 |
| 4,688,371 | 8/1987 | Hecht | 141/83 X |
| 4,703,782 | 11/1987 | Henkel, Sr. | 141/114 X |
| 5,036,893 | 8/1991 | De Crane | 141/114 |
| 5,056,571 | 10/1991 | Derby | 141/114 |

OTHER PUBLICATIONS

Mosier Industries, Inc.—Tran-Sair Systems—p. 3 Catalog Distributed by Hydragear, Inc. Shreveport, La. (1987).

*Primary Examiner*—Ernest G. Cusick
*Attorney, Agent, or Firm*—Norvell E. Von Behren

[57] ABSTRACT

A method for quickly and safely hanging a bulk unfilled bag having a plurality of bag loops on the latches of a bag filling machine with traversing latch mechanisms. The rear latch mechanisms are movable forwardly towards the front fixed latches to permit the operator of the machine to easily and safely hang the bag loops on the latches. Thereafter the rear traversing latches are moved to the rear of the machine to open the bag thus allowing it to be filled and later released from the latches.

5 Claims, 4 Drawing Sheets

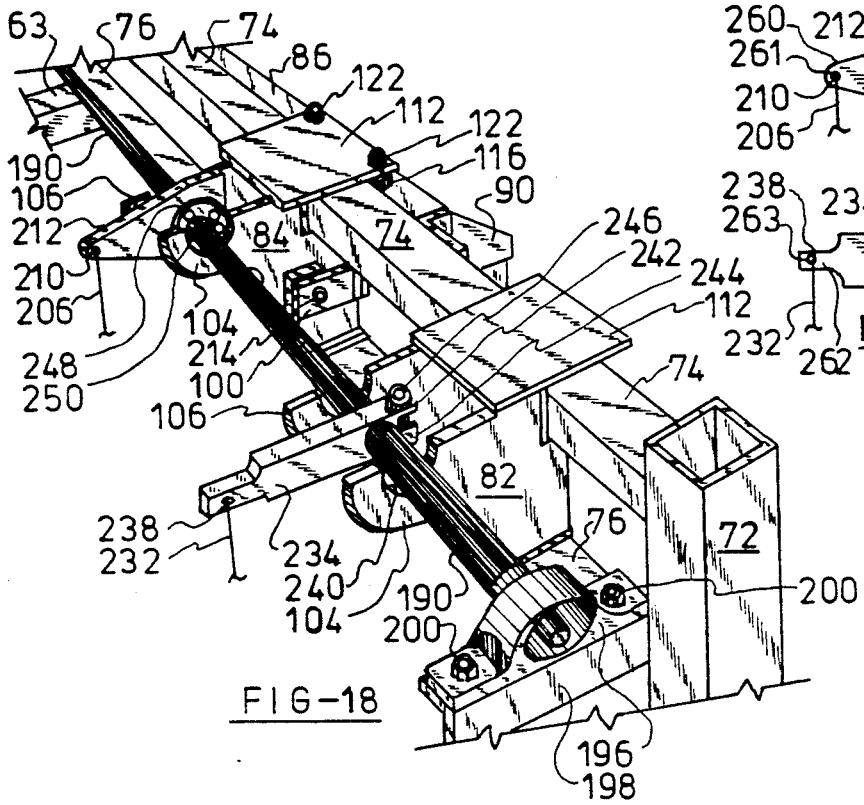
FIG-18
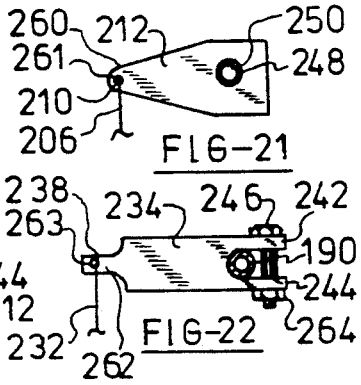
FIG-21
FIG-22
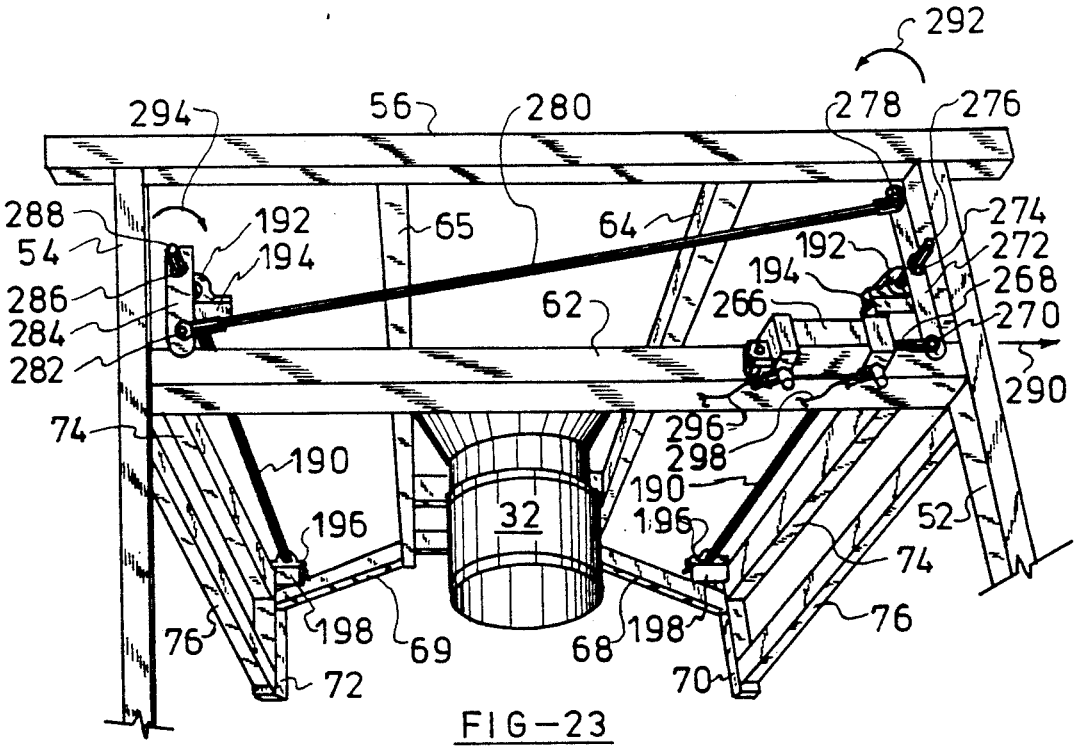
FIG-23

METHOD FOR HANGING A BULK UNFILLED BAG ON LATCHES OF A BAG FILLING MACHINE

CROSS REFERENCE TO RELATED APPLICATIONS

U.S. Pat. No. 4,676,284, filed May 22, 1985 under Ser. No. 737,023 and issued Jun. 30, 1987 to Charles E. DeCrane.

U.S. patent application Ser. No. 07/497,684, filed Mar. 23, 1990 by Charles E. De Crane and entitled "Bag Filling Machine With Traversing Latch Mechanism".

BACKGROUND OF THE INVENTION

This invention relates generally to bag filling machines and more specifically to a new and improved bag filling machine having traversing latch mechanisms which permit easy positioning of an empty bag onto the bag latches prior to filling the bag.

With the advent of large containers for the shipment of bulk materials from one location to another, there was introduced into this country approximately fifteen years ago large square woven polypropylene bags for this purpose. These bulk bags had a capacity ranging from twenty cubic feet up to seventy cubic feet and would vary in size from thirty-five inches wide by thirty-five inches long by twenty-three inches high up to the same width and length bag having a height of eighty-two inches unfilled.

These bags were constructed with bag loops on the top of the bag which were used for transporting the bags from one location to another. The loops were also used for holding the bags while they were being filled in a filling machine. The bag loops were generally constructed of a strong web-like material which was sewn onto the upper corners of the square bag.

With the introduction of these bags, prior art bag filling machines soon encountered problems in removing the filled bag from the filling machine. Since the filled bags weighed as much as two thousand pounds, the problems encountered were in removing the filled bag from the filling machine. When the bag was filled, a portion of the two thousand pound weight was applied to the bag loops. This resulted in difficulty in getting the bag loop from the device holding the bag in the machine.

The bag loops would tend to hang upon the various rods or hooks used since many times the material being filled in the bag was a sticky material and the environment around the filling machine was one of a dust laden atmosphere containing the sticky material. In FIGS. 1 and 2 of the drawings of the applicant's before described U.S. Pat. No. 4,676,284 there is shown several of the prior art bag filling machines shown holding the large bulky bags.

In the same U.S. Pat. No. 4,676,284, there is shown in FIGS. 3–10 of the drawings and there is described in the patent the applicant's unique solution to the problems using novel releasable supporting arms which are inclined downwardly and inwardly. This novel arm design will be extensively referred to hereinafter and will also be referred to as latches for holding the bag loops. The applicant's bag filling machine with releasable supporting arms or latches was very satisfactory for use in certain required situations and was well accepted commercially in the marketplace.

However, situations occurred where the placing of the bag loops on the latches resulted in safety and time considerations. The applicant's machine was originally designed with four fixed latches in each corner of the machine. This required the worker to lean into the machine from various positions to hang the bag loops on the latches. In the alternative, the worker would have to move around the machine to place the loops on the latches resulting in more time required to set up the machine for filling the bag.

It was also found that the applicant's unique bag filling machine was often placed in a crowded shop environment which did not easily give the worker access to moving around the machine and he would then have to lean into the machine to place the bag loops on the latches resulting in safety problems.

It was also discovered that many bag filling operations desired to use several size of bags which were not able to be handled by the applicant's original design. While this original unique bag machine had vertical provisions for variations in bag length, the fixed corner latch machanisms of the filling machine permitted only one bag size in the horizontal periphery of the bag.

SUMMARY OF THE INVENTION

In order to overcome the before described considerations encountered with the prior art bag filling machine there is provided by the subject design a unique bag filling machine with traversing latch mechanisms. The novel latch construction permits the rear pair of latches to be moved forward by means of an air or hydraulic operated cylinders until they are in proximity to the front pair of latches.

Thereafter the operator of the bag filling machine may easily place the bag loops on the latches to hold the bag in place. The rear pair of latches are then moved back to their original position at the rear of the bag machine. The bag may then be filled and released as previously described in the applicants reference U.S. Pat. No. 4,676,284.

Since the bag may now be positioned on the latches from the open front of the machine without leaning into the machine a great distance, any potential safety problems encountered with the old machine have been eliminated. In addition, the time required to set the bag on the latches by the bag loops has been greatly diminished to a few seconds since the operator does not have to move around the machine in order to set the bag loops on the machine latches.

The applicant's novel device also may be used with bags having different horizontal peripheries or bag sizes. The front pair of bag latches are fixed to the extent that they do not normally move or traverse during the initial placement of the bag loops on the latches. However, they are designed to be adjustable horizontally a limited distance to accommodate a different size bag in the filling line.

The novel design of the traversing latch machanisms of the bag machine is accomplished using a frame comprising in part a pair of spaced apart members cantilevered and positioned on each side of the frame. The cantilevered pairs of members are designed to carry the rear pair of traversing latches and the front pair of fixed latches. The holding means or latches used on the machine to hold the bag loops are designed to function similarly to those on the applicant's original design covered by U.S. Pat. No. 4,676,284.

This includes a plurality of downwardly and inwardly inclined members which are positioned toward the central opening in the bag. Two of the inclined members are fixedly attached to the oppoisite pair of cantilevered members and two of the inclined members are movably carried by the frame by moving means in the form of air or hydraulic cylinders.

The release of the filled bag from the latches containing the inclined members is then accomplished by release means which co-act with the holding means to permit the filled bag to release itself by gravity from the holding means upon an activation of the holding means. Activating means are used to activate the release means at a pre-determined time.

Accordingly it is an object and advantage of the invention to provide a new and improved bag filling machine which permits the loops of the empty bag to be quickly and safely positioned on the inclined portion of the bag machine latches where they may be subsequently released by gravity after the bag has been filled.

Another object and advantage of the invention is to provide a new and improved bag filling machine having traversing bag latches and fixed adjustable latches which permit several sizes of bags to be used in the machine without requiring costly changeover time from one bag to another.

Still another object and advantage of the subject invention is to provide a new and improved bag filling machine which is safer to operate and which does not require the operator to lean a great distance into the machine to hang a bag on the inclined latches by the four bag loops.

These and other objects and advantages will become apparent from a review of the drawings and from a study of the description relating to the drawings which has been given by way of illustration only.

BRIEF DESCRIPTION OF THE DRAWINGS

FIG. 11 is a side view and FIG. 12 is a top view, taken along lines 12—12 of FIG. 11.

FIG. 18 is a top perspective plan view, taken along lines 18—18 of FIG. 16, showing in more detail a portion of the activating means used to operate the bag machine latches.

FIGS. 21 and 22 are side elevational views of the rocker plates used with the rear and front latches respectively of the applicant's bag machine.

FIG. 23 is a rear perspective elevational view, looking from the rear of the applicant's bag machine towards the open front portion and showing in more detail further portions of the activating means used to operate the bag machine latches.

DESCRIPTION OF THE PREFERRED EMBODIMENT

Figure 1:
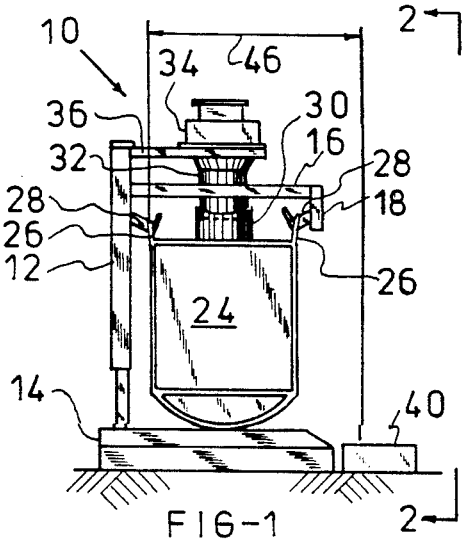
FIG-1 PRIOR ART
FIG. 1 is a left side elevational view of the applicant's original bag filling machine shown and described in his U.S. Pat. No. 4,676,284.
Figure 2:
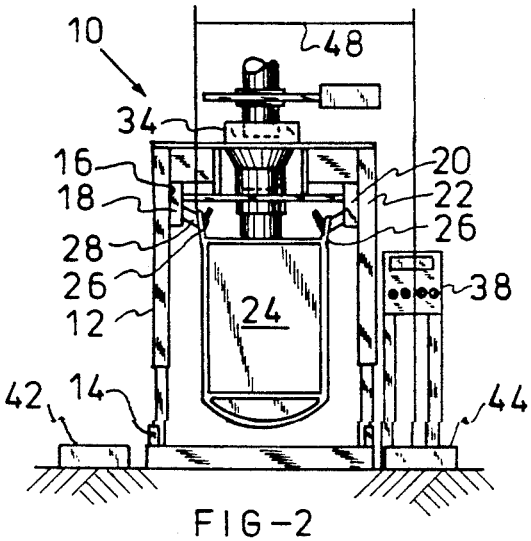
FIG-2 PRIOR ART
FIG. 2 is a front elevational view, taken along lines 2—2 of FIG. 1.

Referring now to the drawings in general and in particular to FIGS. 1 and 2 of the drawings there are shown views which are prior art and represent the applicants original bag filling machine shown and described in his U.S. Pat. No. 4,676,284. FIGS. 1 and 2 of this application are the same as FIGS. 3 and 4 of the applicant's patent with the numerals being changed in this application for purposes of clarity.

FIG. 1 is a left side elevational view of the prior art bag filling machine shown herein generally as the numeral 10 comprising a frame 12 movably attached to a lower stand 14. A single cantilevered arm 16 was rigidly attached to the frame 12 on one side and had a downwardly extending member 18 attached thereto. The opposite side of the bag filling machine 10 had a similar cantilevered arm 20 with a downwardly extending member 22. The empty bag 24 with bag loops 26 was hung on the rigid holding means or latches 28.

When positioned thusly, the upper neck 30 of the bag could be positioned around the filling spout 32 attached to the bag filling mechanism 34 which was supported by the upper arm 36 attached to the upright frame portion 12. FIG. 2 is a front elevational view, taken along lines 2—2 of FIG. 1 and shows the control station 38 used to operate the filling mechanism for filling the bag.

Since the latch holding means 28 were fixedly attached to both the rear upright portion of the frame 12 and to the downwardly extending members 18 and 22, an operator was required to stand in the work areas 40, 42 and 44 in order to place the bag loops 26 on their respective latches 28. This would require him to move around the outer portion of the bag machine to hang the loops on the latches which presented problems in certain shop locations where tight space conditions did not also permit this to be done with ease. For example, a filled bag conveyor may be positioned in one of the work areas such as the area 42 which would require the operator to have to straddle or step over the conveyor to hang the bag loops 26 on the latch holding means 28.

As an alternative the operator would lean into the center of the machine to hang the opposite bag loops from one of the work areas. For example the operator may stand in the work area 40 in the front of the machine and lean into the machine the distance shown by the numeral 46 in FIG. 1 to hang the bag loops 26 on the rear latches 28. He may also stand on the side of the machine in the work area 44 and lean into the machine the distance shown by the numeral 48 in FIG. 2 to hang the left side bag loops 26 on the latches 28.

It can be readily seen how the leaning into the machine could place the operator in an unsafe position in the event that the bag filling mechanism 34 would malfunction and discharge bulk product while the operator was leaning inside the machine. In addition, the leaning into the machine by the operator may also be unsafe since the operators back could be stretched to an unnatural position which could cause internal injuries to him.

Figure 3:
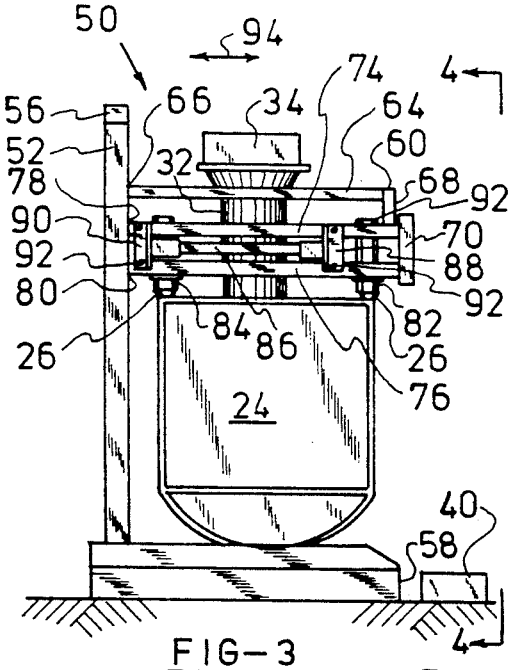
FIG. 3 is a left side elevational view of the applicant's novel design of the subject application showing the left side spaced apart cantilevered members upon which are hung the latch mechanisms to release the filled bag from the machine.
Figure 4:
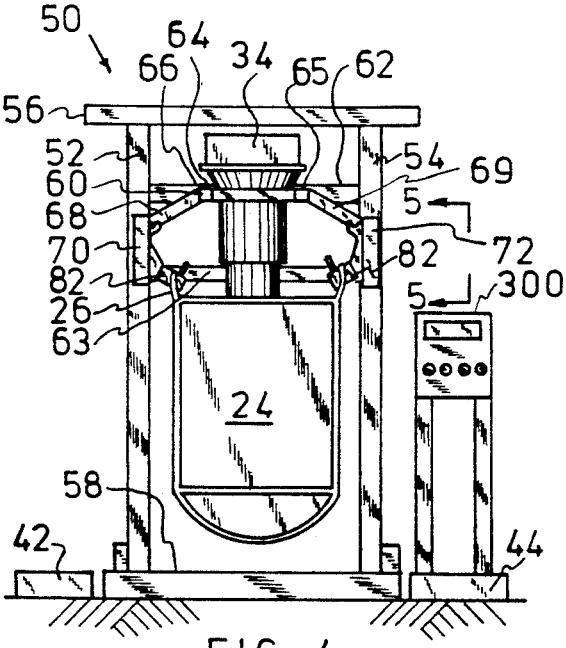
FIG. 4 is a front elevational view, taken along lines 4—4 of FIG. 3.

Accordingly, the applicant's novel bag filling machine, shown by the numeral 50 in FIGS. 3 and 4 was designed to alleviate these undesirable considerations. A pair of upright frame members 52 and 54 and attached to a base 58 with a horizontal frame member 56 being fixedly attached to the top of the machine 50. A filler support structure 60 is rigidly attached on one end to the horizontal frame 62 and a similar horizontal frame 63 is positioned below the frame 62. The filler support members 64 and 65 are welded at 66 to the horizontal frame 62 and the angled members 68 and 69 are welded to the filler support members 64 and 65.

The above described frame member supports the bag filling spout 32 and the bag filler mechanism 34 and are also supported by the cantilevered ends of a pair of horizontal, spaced apart frames 74 and 76. These spaced apart frames 74 and 76 are welded at 78 and 80 to the upright frames 52 and 54 on one end and to a pair of short vertical frame members 70 and 72 on the opposite ends.

The pair of spaced apart cantilevered arms 74 and 76 on each side of the bag filling machine 50 support and carry the pair of novel improved latches or holding means 82 and 84 positioned on each side of the machine. The front latches 82 are fixed and held stationary on the cantilevered arms 74 and 76 but they may be adjusted horizontally a limited distance to accommodate different bag sizes. The limited adjustment can be seen in FIG. 5 of the drawing and is represented by the arrow distance 96. The rear latches 84 are traversing latches and move forward and rearward, in the direction shown by the arrow 94 at predetermined times as will be described in detail hereinafter.

The movement of the rear latches 84 on each side of the bag machine 50 is controlled by a pair of air, electric or hydraulic cylinders 86 on each side of the bag machine 50 and which are mounted on the angle mounts 88 and 90 on the outside of the machine and on the cantilevered arms 74 and 76. The caps screws 92 hold the angle mounts 88 and 90 onto the arms 74 and 76.

Figure 5:
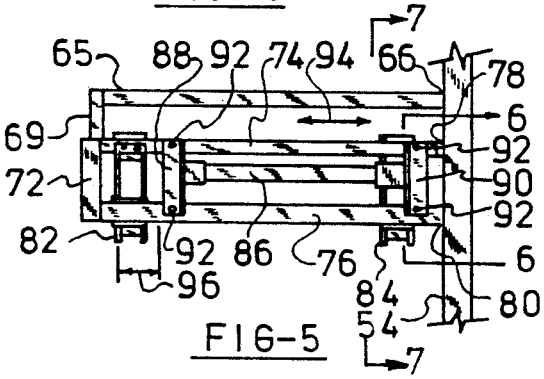
FIG. 5 is a partial right side elevational view, taken along lines 5—5 of FIG. 4 showing the right side spaced apart cantilevered members.

FIG. 5 is a partial right side elevational view, taken along lines 5—5 of FIG. 4 and shows the right side of the spaced apart cantilevered members 74 and 76 on the applicant's bag machine 50. Also shown in FIG. 5 is the mounting of the air, electric or hydraulic cylinder 86 on the angle mounting bracket 88 and 90. The left side of the applicant's bag machine 50 is constructed similarly and it can be seen how the rear latches 84 on both sides of the machine are moved by the air, electric or hydraulic cylinders 86 attached on each side of the machine.

Figure 6:
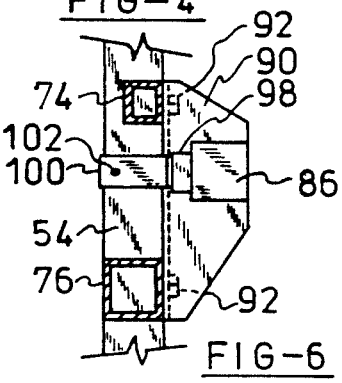
FIG. 6 is a partial elevational cross-sectional view, taken along lines 6—6 of FIG. 5 showing the brackets used to hang the air, electric or hydraulic cylinder moving means on the spaced apart cantilevered members.
Figure 8:
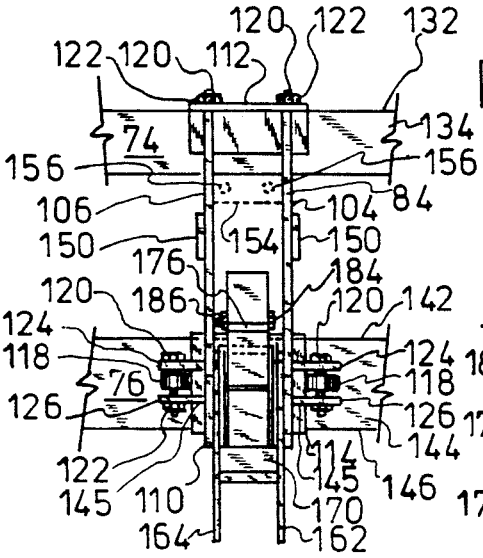
FIG. 8 is a partial front elevational view, taken along lines 8—8 of FIG. 7 showing more detail on the latch construction and how it is carried by the spaced apart cantilevered members.

FIG. 6 is a partial elevational cross-sectional view, taken along lines 6—6 of FIG. 5 and shown how the angle mounting brackets 88 and 90 are fixedly attached to the upper spaced apart cantilevered member 74 and to the lower member 76 by the cap screws 92. It can also be seen how the movable mounting member 98 of the air, electric or hydraulic cylinder 86 is attached to a U-shaped bracket 100 which has a pair of holes 102 formed in each side to mount the movable latches 84 onto the mounting member of the cylinder as will be described hereinafter. There will also be described more details of the particular latch mountings hereinafter especially when referring to the drawing FIGS. 13-17 and others following thereafter.

Figure 7:
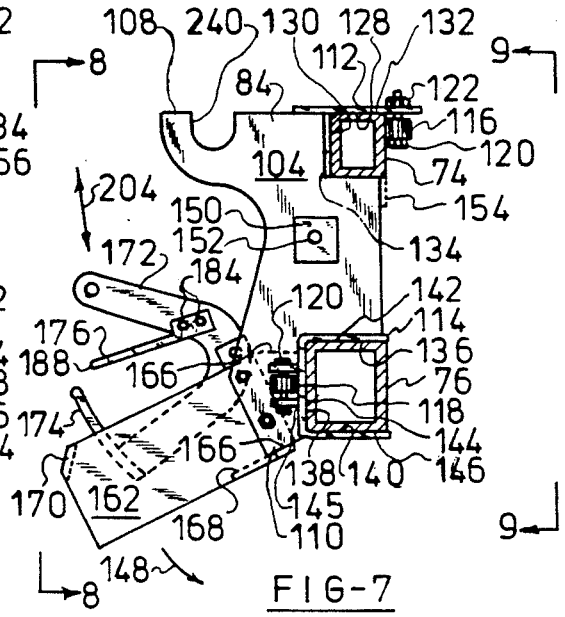
FIG. 7 is a cross-sectional side elevational view, taken along lines 7—7 of FIG. 5 showing in more detail the improved holding means or latches used to hold the bag loops on the latches while the bag is being filled.

Referring now to the drawing FIGS. 7 to 10, there will be described in more detail the particular construction of the improved latches 82 and 84. FIG. 7 is a cross-sectional side elevational view, taken along lines 7—7 of FIG. 5 and shows the movable latch 84 positioned on and carried by the upper and lower horizontal spaced apart members 74 and 76. The fixed latches 82 are similarly constructed with minor changes which will be detailed hereinafter. A pair of spaced apart vertical plates 104 and 106 having a top portion 108 and a bottom portion 110 are welded to the T-shaped plate 112 on the top portion 108. A C-shaped plate 114 is welded to the bottom portion 110 of each vertical plate 104 and 106. The T-shaped plate 112 and the C-shaped plate 114 serve to space the vertical plates 104 and 106 apart and to ride on the horizontal spaced apart members 74 and 76.

It can be seen how the underside 128 of the T-shaped plate as well as the inside 130 of the same plate bear on the exterior surfaces 132 and 134 of the upper horizontal cantilevered member 74. In a similar manner the inner sides 136, 138 and 140 of the lower C-shaped plate 114 bear on the exterior sides 142, 144 and 146 of the lower horizontal cantilevered member 76.

A pair of upper rollers 116 and a pair of lower rollers 118 are mounted by the bolts 120 and are held in place by the nuts 122 as shown. The upper bolts 120 are positioned through vertical holes (not shown) in the T-shaped plate 112 while the lower bolts 120 are positioned through vertical holes (not shown) in the spaced apart horizontal plates 124 and 126 which are welded at 145 to the exterior surface of the lower C-shaped plate 114. The pair of upper and the pair of lower rollers 116 and 118 serve to aid the movable latches 84 as they horizontally tranverse along the frame and to restrain angular downward motion in the direction of the curved arrow 148 resulting from the weight of the latches and the weight of the filled bag on the latches and the cantilevered members 74 and 76.

A pair of side pads 150 are welded on the outside of the vertical plates 104 and 106 of the movable latches 84 and contain drilled and tapped holes 152 for attaching the movable latches 84 to the U-shaped bracket 100 shown in FIG. 6 of the drawings. The fixed latches 82 do not have the side pads 150 since these latches are not connected to the air, electric or hydraulic cylinders 86. The fixed latches 82 also contain a plate 154 containing drilled and tapped holes 156 which are shown dashed in FIGS. 7 and 8. These plates 154 are not used on the movable latches 84 and are used to tightly fasten the fixed latches to the upper cantilevered member 74 at their desired position as shown in FIG. 10.

Figure 9:
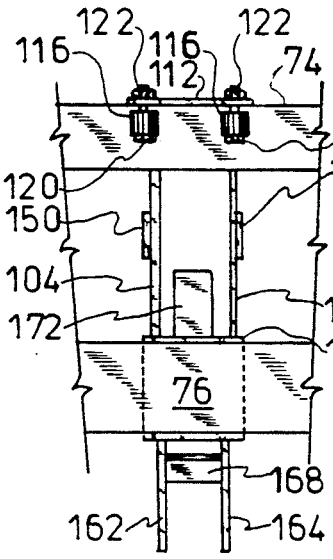
FIG. 9 is a partial rear elevational view, taken along lines 9—9 of FIG. 7 showing more detail on the hanging of the traversing latches on the spaced apart horizontal cantilevered members.
Figure 10:
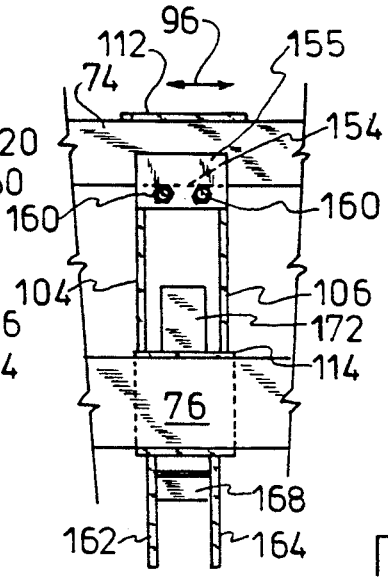
FIG. 10 is a view, similar to the view of FIG. 9 showing the rear of the fixed adjustable latches which are positioned on opposite sides on the front portion of the bag machine.

By referring now to the drawing FIGS. 9 and 10 there can be seen partial rear view of the hanging of the latches 82 and 84 on the cantilevered members 74 and 76 and the use of the plate 154 on the fixed latches. FIG. 9 is a partial rear view, taken along lines 9—9 of FIG. 7 and shows the rear of the movable latches 84 while FIG. 10 is a similar view and shows the rear of the fixed latches 82. The plate 155 is held in place onto the plate 154 by the cap screws 160 on the fixed latches 82 which permits the fixed latch to be horizontally adjustable a limited amount shown by the arrow 96 to accommodate different size bags. When the proper position for the fixed latches 82 is obtained the cap screws 160 are tightened in the drilled and taped holes 156 of the plate 154 and the plate 155 will tightly hold the fixed latch 82 onto the horizontal cantilevered member 74.

Referring back to FIGS. 7-8 there is shown how each latch 82 and 84 is constructed with a pair of spaced apart inclined plates 162 and 164 which are welded at 166 to the bottom portion 110 of the spaced apart vertical plates 104 and 106. A pair of plates 168 and 170 are welded at the position shown to hold the inclined plates 162 and 164 in a spaced apart position. Positioned between the plates 162 and 164 is a C-shaped hook 172 having a plate 174 welded thereto. The positioning of the C-shaped hook 172 between the plates 162 and 164 and its function as well as the function of the downwardly and inwardly extending plates 162 and 164 is similar to the applicants original design as shown in FIGS.7, 7A, and 7B of the U.S. Pat. No. 4,676,284.

Figures 11, 12:
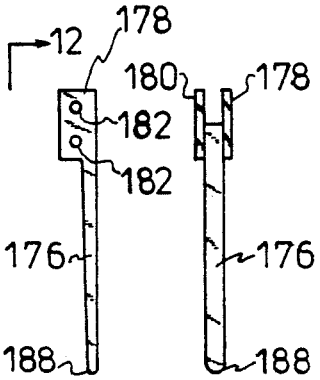
FIGS. 11-12 are views of the securing device used on each latch to insure that the bag loops do not jump or move off of the inclined portion of the bag latches.

Reference should be made to that patent in general and specifically to those FIGS. 7, 7A and 7B to more fully understand how the new bag machine latches 82 and 84 function to hold the bag loops on the latches and how they are released from the latches by gravity. By referring now to FIGS. 11 and 12 of this application, there will be seen how the C-shaped hooks 172 have been modified over the applicant's original design of U.S. Pat. No. 4,676,284. FIG. 11 is a side view of a securing device 176 which is formed of plastic with a pair of bifurcated arms 178 and 180 having holes 182 formed therein. The holes 182 are used to position a pair of bolts 184 (shown in FIGS. 7 and 8) which are held in place by a pair of nuts 186 on the other side of the securing device. The bolts 184 are positioned in the drilled holes 182 of the securing device 176 and in drilled holes (not shown) through the C-shaped hook 172 on each latch 82 and 84. This can be seen clearly in FIGS. 7 and 8 of the drawings.

An elongated finger 188, which can be seen in FIGS. 7, 11 and 12, is also formed on the securing device 176 and the plastic finger 188 can be bent downwardly when placing the bag loops 26 on the latches 82 and 84. Thereafter the plastic finger 188 on each latch 82 and 84 will spring back to their original position as shown to prevent the bag loops from accidentally coming off of the latch as the bag is opened prior to being filled.

Figure 13:
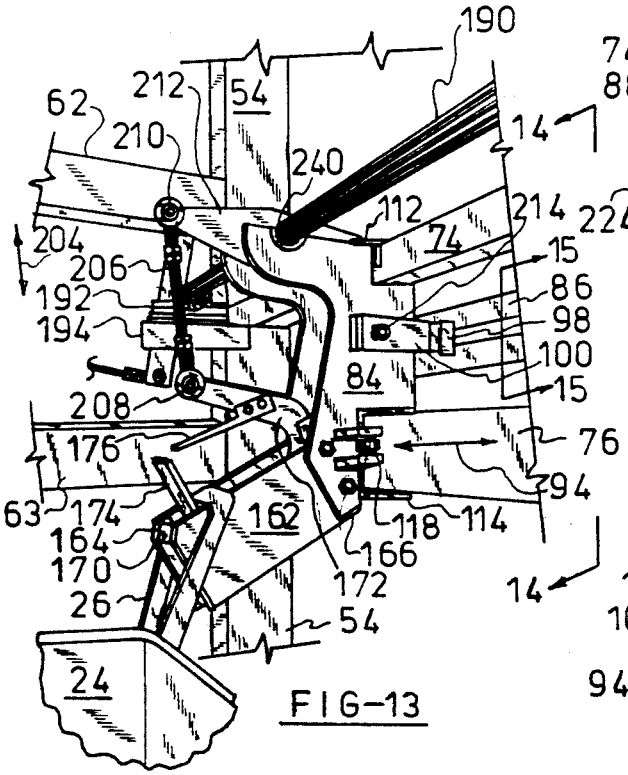
FIG. 13 is a perspective view looking into the bag machine from the open front of the machine and looking towards the right side of the rear portion of the machine showing the right side traversing bag latches in position on the right side horizontal spaced apart cantilevered members of the machine frame.

Referring now to FIGS. 13-17 of the drawings there will be described in more detail the before described novel features of the applicant's improved bag filling machine. FIG. 13 is a perspective view, looking into the bag machine from the open front of the machine and looking towards the right side of the rear portion of the machine. FIG. 13 shows how the right side traversing bag latch 84 is positioned on the right side horizontal cantilevered members 74 and 76 and how the traversing latch 84 is movable forward and rearward in the direction of the arrow 94. The opposite or left side transversing latch 84 would be similarly mounted.

FIG. 13 also shows the holding means for the bag loops 26 in the form of the spaced apart inclined members 162 and 164 as well as the release means in the form of the C-shaped hook 172 and its attached plate 174. The means for activating the release of the bags is shown in part by a pair of elongated activating rods 190 which are rotatably mounted on each side of the bag machine 50. One end of the activating rod 190 is carried by a rear pillar block mounting 192 which is bolted to a horizontal angle bracket 194 which is welded to the upright frame member 54 as shown in FIG. 13. The opposite or left side of the bag machine would be similarly constructed to hold the pillar block mounting 192 for the activating rod 190 on that side of the machine.

Figure 17:
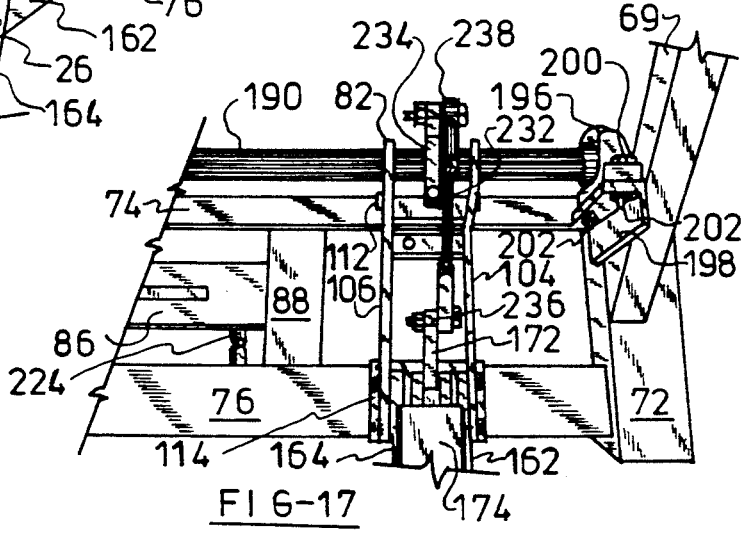
FIG. 17 is a side perspective view, similar to the view of FIG. 16 shown looking more to the front right side of the bag machine and showing in more detail the front right side fixed adjustable latches used in the applicants unique machine.

The other end or front end of each activating rod 190 is carried by a front pillar block mounting 196 which can be seen in FIG. 17 of the drawings and both pillar block mountings 192 and 196 are bolted to their respective angle brackets 194 and 198 by a pair of bolts 200 and nuts 202. Referring back to FIG. 13 of the drawings there can also be seen how the C-shaped hooks 172 are pivoted in the direction of the arrow 204 by a connecting rod 206 which is pivotably mounted at the bottom at 208 to the C-shaped shaped hook 172 and is pivotably mounted at the top at 210 to the rocker plate 212 which also forms part of the activating means to activate the C-shaped hooks 172 and plates 174.

FIG. 13 also shows how the movable latches 84 are mounted onto the air, electric or hydraulic operated cylinders 86 on its movable mounting member 98 by the U-shaped bracket 100 and the cap screws 214. There can also be seen how the bag loops 26 of the bag 24 are held on the inclined plates 162 and 164 of the traversing latches 84.

Figure 14:
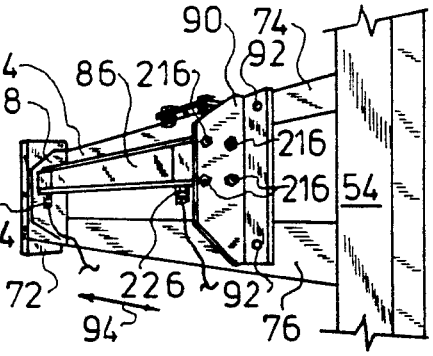
FIG. 14 is a partial side elevational view, taken along line 14—14 of FIG. 13 and showing the mounting of the air, electric or hydraulic cylinders used in the preferred embodiment to move the rear traversing latches on the applicant's novel machine.
Figure 15:
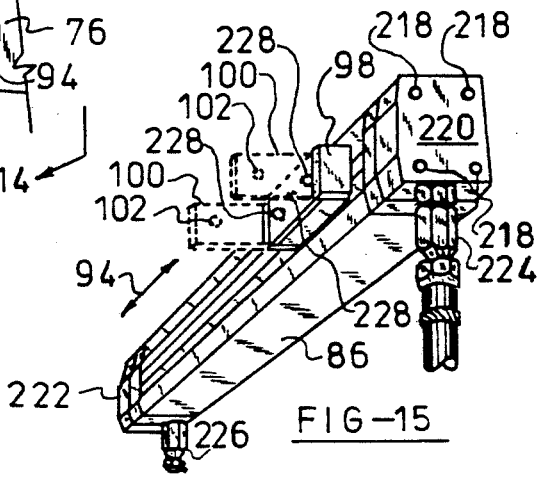
FIG. 15 is a side elevational view, taken along line 15—15 of FIG. 14 showing in more detail the construction of the air, electric of hydraulic cylinder shown in FIGS. 13 and 14.

Referring now to FIGS. 14 and 15 of the drawings, there are shown more details of the air, electric or hydraulic cylinders 86. As before described, the cylinders are mounted between a pair of angle mounts 88 and 90 by the bolts 216 which are positioned in holes (not shown) in the angle mounts 88 and 90 and into drilled and tapped holes 218 on each end 220 and 222 of the cylinders 86. In the preferred embodiment shown, air operated cylinders 86 as manufactured by Mosier Industries, Incorporated, 325 Carr Drive, Brookville, Ohio 45309 have been selected and are of the type shown known as RCB40 cylinders. Air connections 224 and 226 are positioned on each end of these cylinders and are connected to an air supply system and operator of the type known in the art.

The movable mounting member 98 of this air cylinder contains a plurality of drilled and tapped holes 228 which are used to bolt the U-shaped bracket 100 to the movable latches 84 with three bolts not shown in the drawing. In FIG. 15, the U-shaped bracket 100 has been shown in dashed lines for clarity and the three mounting bolts have also been omitted.

Figure 16:
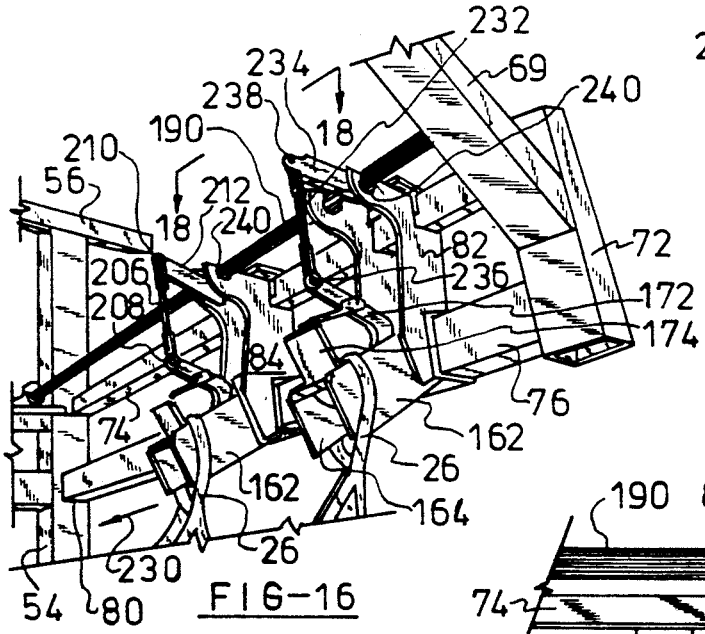
FIG. 16 is a perspective view, similar to the view of FIG. 13 showing the rear traversing latch positioned in proximity to the front fixed adjustable latch as they would be with the bag loops being shown positioned on the inclined portion of the latches.

Referring now to FIGS. 16 and 17 of the drawings there is shown in FIG. 16 a perspective view, similar to the view of FIG. 13. The rear traversing latch 84 is shown after being moved forward towards the bag machine front and is positioned in close proximity to the front fixed latch 82 in the position that the latches would be prior to the bag loops 26 being hung on the inclined portions of the latches from the open front of the bag machine. After all of the bag loops 26 have been placed on the latches 84 and 82, then both the left side and the right side rear traversing latches 84 are moved rearward in the direction of the arrow 230.

There can also be seen in FIG. 16 how the front fixed latches 82 are activated by the rocker plate 234 through the connecting rod 232 which is pivotably mounted on the lower end at 236 to the C-shaped hook 172 and the plate 174 of the fixed latches 82. The connecting rod 232 is also pivotally mounted at its upper end 238 to the rocker plate 234. The connection of the rocker plates 212 and 234 to the elongated activating rod 190 will be detailed hereinafter when referring to FIGS. 18–22. The elongated activating rod 190, on each side of the bag machine, is positioned in, but not carried by, the notches 240 formed in the top portion 108 of each vertical plate 104 and 106.

Referring now to FIG. 17 of the drawings there is shown a front perspective view, similar to the view of FIG. 16 but at a slightly different angle. FIG. 17 shows in more detail the front fixed latches 82 which are adjustable a limited distance horizontally as before described. There can also be seen in FIG. 17 the connection of the rocker plate 234 to the elongated horizontal activating rod 190. The left side of the bag machine is similarly constructed. In FIG. 17, the rear traversing latches 84 have been moved rearwardly to the back of the bag machine into the position shown in FIG. 13 of the drawings and are not seen in FIG. 17.

Referring now to FIG. 18 of the drawings, there is shown a top perspective plan view, taken along lines 18—18 of FIG. 16 which details the connections of the front rocker plate 234 and the rear rocker plate 212 to the elongated horizontal activating rod 190 on both sides of the machine. Since the front fixed latch 82 is not movable except for a change in bag size, then the front rocker plate 234 is clamped onto the elongated horizontal activating rod 190 by a pair of bifurcated arms 242 and 244 held tightly together by the bolt 246 and nut (not shown). When the front fixed latches 82 on each side of the bag machine are to be horizontally adjusted for a different bag size, then the bolts 246 on each front latch 82 are loosened and the rocker plate 234 with its connecting rod 232 on each front latch 82 is moved horizontally to the desired position along the rods 190 on each side of the bag machine. When the new position is determined, then the bolts 246 are tightened and the rocker plates 234 will rotate as the rods 190 rotate on each side of the bag machine.

It can also be seen how the rear rocker plates 212 on each side of the bag machine, are activated by the rods 190. Since the rear traversing latches 84 are movable as before described, the connection of the rear rocker plates 212 to the rods 190 is through a linear ball bearing 248 which is press fit into a hole 250 formed in the rear rocker plates 212. The elongated rod 190 is a ball spline rod of the type having splines or grooves formed in the rod to receive the balls of the linear ball bearing 248. When constructed thusly, the linear ball bearing is free to move horizontally along the ball spline rod 190 carrying the rear rocker plates 212 as the rear traversing latches move on each side of the bag machine. In addition, whenever the ball spline rods 190 rotate, the linear ball bearings 248 will also rotate along with the rear rocker plates 212. This will then activate or move the rear connecting rods 206 upwardly or downwardly as desired to activate the rear latches 84.

Figure 19:
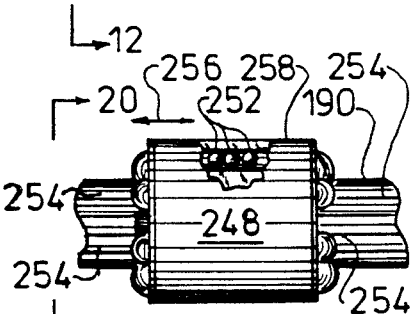
FIG. 19 is a partial side elevational view of the linear ball bearing used in connection with the rear traversing latches.
Figure 20:
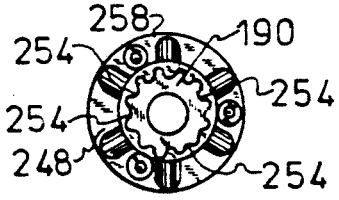
FIG. 20 is an end elevational view, taken along lines 20—20 of FIG. 19.

Referring now to FIG. 19 of the drawings there is shown a side elevational view of the linear ball bearing 248 showing the elongated activating rod 190 positioned through the bearing. The internal balls 252 of the bearing are shown in a breakaway portion of FIG. 19 and ride in the elongated grooves 254 of the elongated activating rod 190. This permits the linear ball bearing 248 to move horizontally in the direction shown by the arrow 256 and also to rotate the rear rocker plates 212 which are pressed on the bearing outer circumference 258 into the holes 250 of the plates 212. FIG. 20 is an end view, taken along lines 20–20 of FIG. 19 and shows more detail of the linear ball bearing 248. The arrow direction 256 of FIG. 19 is the same direction as the arrow 94 in the other views, both of which represent the traverse direction of the rear latches 84.

Referring now to FIGS. 21 and 22 there are shown reduced side elevational views of the rocker plates 212 and 234 respectively. As before described in the internal hole 250 is pressed the outer circumference 258 of the linear ball bearing 248 so that its outer circumference 258 is tightly held therein. The extended arm 260 has an internal hole 261 through which is placed the pin or bolt mounting 210 to pivotably mount the connecting rod 206 used to activate the C-shaped hook 172 and plate 174 on the rear traversing latches 84. In a similar manner, the front fixed latches 82 are connected to their C-shaped hook 172 and plate 174 through the connecting rods 232 which are pivotably mounted at 238 through a hole 263 to the extended end 262 of the rocker plate 234. As before described, since the front latches 82 are not movable except for adjustment in different bag sizes, the bifurcated arms 242 and 244 will tightly hold the rocker plate 234 onto the elongated activating rod 190 as the bolt 246 and nut 264 are tightened.

Referring now to FIG. 23, there is shown a rear perspective elevational view, looking up from the rear of the applicant's bag machine towards the open front portion. The view of FIG. 23 shows detail of further portions of the activating means used to operate the bag machine latches. For purposes of clarity, the two latches 82 and 84 on each side of the bag machine have not been shown and other portions of the applicant's bag machine have also been omitted and FIG. 23 is primarily designed to show the operation of the elongated horizontal activating rods 190 positioned on each side of the bag machine. As before described, the front end of the elongated activating rods 190 are carried by the front pillar block mountings 196 and the rear end of the elongated activating rods 190 are carried by the rear pillar block mountings 192.

An air, electric or hydraulic cylinder 266 has been mounted on the horizontal member 62 forming part of the machine frame. The cylinder activating rod 268 is rotatably mounted at 270 to the vertical bar 272 by known means. The bar 272 is fixedly mounted by a plurality of bolts 274 to the threaded end 276 of the elongated activating rod 190 on the left side of the bag machine. The upper end of the bar 272 is rotatably mounted at 278 on the elongated diagonally positioned rod 280 which crosses the rear of the bag machine. The rod 280 is also rotatably mounted at 282 to the vertical bar 284 which is also fixedly mounted, by a pair of bolts 286 to the threaded end 288 of the horizontal elongated activating rod 190 on the right side of the bag machine.

It can be seen that whenever the cylinder activating rod 268 of the activating cylinder 266 moves to the right, in the direction of the arrow 290, the elongated activating rod 190 on the right side of FIG. 23 will rotate counter-clockwise in the direction shown by the arrow 292. In a like manner, the elongated activating rod 190 on the left side of FIG. 23 will rotate clockwise in the directions shown by the arrow 294. This will then force the C-shaped hooks 172 of the latches 82 and 84 downwardly along with the plates 174 as the C-shaped hooks pivot on their respective pivots as discussed more fully in the applicant's U.S. Pat. No. 4,676,284, thereby releasing the bag latches 82 and 84 and permitting the bag loops 26 to slide off of the inclined portions of the latches by gravity.

A reverse of the process by moving the cylinder activating rod 268 in the opposite direction will then reverse the direction that the C-shaped hooks 172 pivot to place them in the position shown in FIGS. 7, 13, and 16 of the drawings of this application.

The applicant's novel bag filling machine is designed, in the embodiment shown, to handle bag sizes of 36"×36" and 36"×42" in the horizontal dimension. The control of the movement of the horizontal cylinders 86 positioned on each side of the machine to move the rear traversing latches 84 is by known control means within the art and would include a valve operator control which could be mounted in the control station 300 shown in FIG. 4 or could be conveniently mounted on the bag machine frame in a different location. The control of the air cylinder 266 used in the preferred embodiment with its air lines 296 and 298 for rotating the horizontal elongated activating rods 190 and also the C-shaped hooks 172 of the bag latches 82 and 84 is also by known control means within the art and would also include a valve operator control which could also be mounted in the control station 300 shown in FIG. 4 or could be mounted elsewhere.

The distance that the rear traversing latch cylinders 86 travel is controlled by magnetic reed switches (not shown) on the cylinders 86 which set the travel for the smaller size bag (36"×36"). A manual stop (not shown) is used to limit the travel of the traversing cylinders 86 when the large size bag (36"×42") is to be filled in the filling machine.

From the foregoing it can be seen that there has been provided a new and novel bag filling machine that accomplishes all of the objects and advantages of the invention as well as others. It should be apparent from a study of the drawings and from a reading of the description of the preferred embodiment that changes may be made in the bag machine and in the various parts of the machine, all of which are considered to be within the spirit and scope of the applicant's invention as described and claimed. While the preferred embodiment presented herein has been given by way of illustration, the applicant is not to be limited to that embodiment only.

Having described my invention, I claim:

1. A method for quickly and safely hanging a bulk unfilled bag having a plurality of bag loops on latches of a bag filling machine with a frame structure having opposite sides and a front and a rear, comprising the steps of:

(a) providing the bag filling machine with at least two fixed latches and with at least two movable latches;

(b) moving the movable latches towards the fixed latches until each movable latch is in proximity to a fixed latch;

(c) hanging the plurality of bag loops on the latches; and (d) moving the movable latches away from the fixed latches to open the bulk unfilled bag so that the bag can then be filled by the bag filling machine.

2. The method as defined in claim 1 wherein the movable latches are moved by cylinders mounted on opposite sides of the bag filling machine.

3. The method as defined in claim 2 wherein the fixed latches are provided on the front of the bag filling machine and the movable latches are provided on the rear of the machine.

4. The method as defined in claim 1 wherein the bag filling machine frame structure has formed thereon a pair of cantilevered horizontal members forming the opposite sides of the bag filling machine and the fixed and movable latches are carried by the pair of cantilevered horizontal members.

5. The method as defined in claim 1 further comprising the step of:

(e) filling the bulk bag; and (f) releasing the filled bulk bag from the fixed latches and from the movable latches.

* * * * *